United States Patent [19]

Mitchell

[11] 4,141,632

[45] Feb. 27, 1979

[54] PHOTOCOMPOSING MACHINE

[76] Inventor: Roger E. Mitchell, 1233 Edlin Pl., Minneapolis, Minn. 55416

[21] Appl. No.: 792,104

[22] Filed: Apr. 29, 1977

[51] Int. Cl.[2] ..... B41B 19/00; B41B 23/00

[52] U.S. Cl. ..... 354/14; 354/13; 354/18; 354/19; 354/292

[58] Field of Search ..... 354/5, 10, 12, 13, 14, 354/15, 18, 19, 292; 355/56

[56] References Cited

U.S. PATENT DOCUMENTS

| | | | |
|---|---|---|---|
| 1,237,239 | 8/1917 | Bunnell | 354/14 |
| 2,160,750 | 5/1939 | Meyer | 354/14 |
| 2,537,069 | 1/1951 | Lohr | 354/14 |
| 3,139,791 | 7/1964 | Bailey et al. | 355/56 |
| 3,308,732 | 3/1967 | Raalt et al. | 354/14 |
| 3,371,577 | 3/1968 | Yatera | 355/56 |
| 3,445,162 | 5/1969 | Klatt | 355/56 |
| 3,592,114 | 7/1971 | Minett | 354/10 |

*Primary Examiner*—Russell E. Adams
*Attorney, Agent, or Firm*—Merchant, Gould, Smith, Edell, Welter & Schmidt

[57] ABSTRACT

A photocomposing machine includes a fiche-like type font having positive and negative character fields, an optical system having a variable magnification and automatic focus compensation for imaging characters on a film strip, and means for conveniently and rapidly selecting individual characters of the positive field of the type font and moving them into alignment with an index light, which simultaneously positions the corresponding negative character in the optical path. A font carrying frame is mounted for simultaneous and direct X and Y movement with respect to the optical path for rapid selection of characters. The object portion of the optical components including the font, and the lens assembly are movable with respect to each other and with respect to the image plane to vary magnification. An automatic focusing cam maintains the focus of the image for all magnifications. The exposure lamp is used in a full power mode for exposure, and in a reduced power mode as the safe light, and means are provided for automatically adjusting the exposure time and the safe light intensity in accordance with different magnifications.

10 Claims, 11 Drawing Figures

FIG. 5
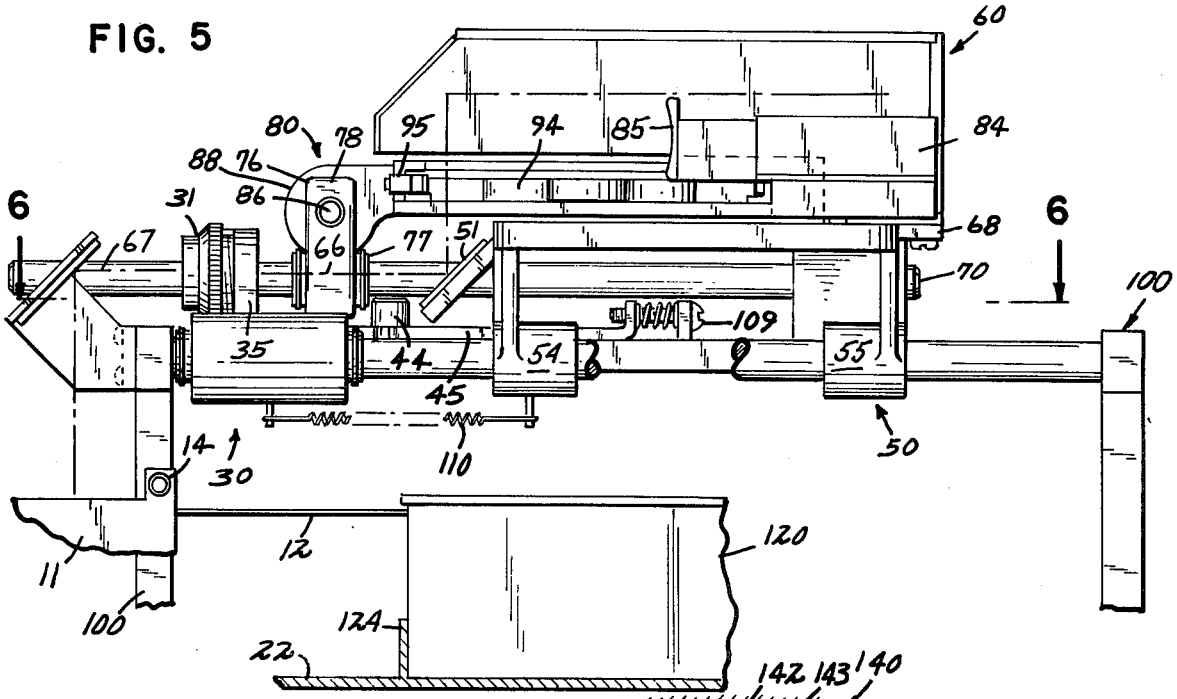
FIG. 6
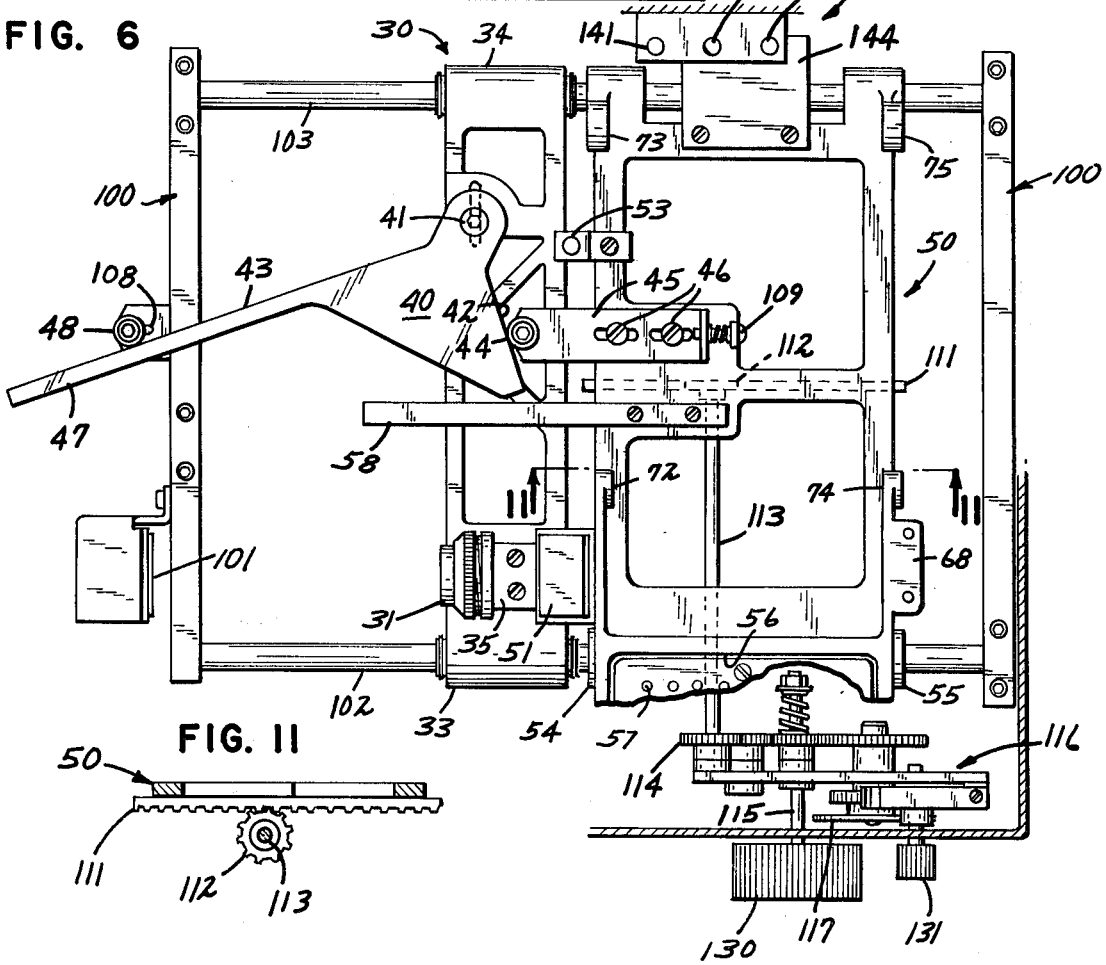
FIG. 11

PHOTOCOMPOSING MACHINE

BACKGROUND OF THE INVENTION

The present invention pertains to the field of photocomposing or phototypesetting machines. Photocomposing machines in the prior art have generally provided a disc or reel which contains negatives of the characters to be printed. Selected characters are projected, one at a time, onto a film or other light sensitive material which may be advanced for each character. The film is subsequently developed to obtain the desired printed legend. Alternatively, in some prior art machines the characters are imaged on a portion of the film within a development cell, and development takes place substantially simultaneously with exposure.

U.S. Pat. Nos. 2,742,831, 3,308,732 and 3,581,632 are examples of machines which use a disc type font which is rotated to align the desired character with the optical path. U.S. Pat. No. 3,115,815 shows an example of a machine using a film strip type font wound on a pair of reels. One disadvantage of these prior art devices is the amount of difficulty and time required in changing from one selected character to another. With a film strip type font wound on reels, it is necessary to crank through most of the font when changing from a character that happens to be at one end of the font, to another which happens to be at the other end of the font. All the while during the cranking, the operator must be watching the characters as they flash past the printing zone under the safe light, until the desired character is reached, because there is no way to go directly from one character to another. This can be annoying with alphabetic characters which follow in known sequence and it can be extremely difficult with characters such as punctuation marks, because the operator might not always remember where certain punctuation marks are on the film strip in relation to other characters. This can lead to a character by character search through a major portion of the font strip.

A similar difficulty exists with disc type fonts, although the situation can be somewhat alleviated since there may be a choice of going either backwards or forwards when changing characters, thus reducing the number of characters that must be passed by on the way to the desired character. Still there is the problem of locating punctuation marks or miscellaneous characters which are not in a logical alphabetical sequence. Since character changes are required many times for a typical job, simplification of character selection can lead to much greater efficiency in the long run.

In U.S. Pat. No. 2,537,069, a fiche-like character sheet is proposed, but the full potential and benefits of a well developed fiche-type system are not realized. In that Patent, the characters are still basically arranged in linear form on the character sheet, thus necessitating long moves when going from the beginning to the end of the alphabet. A pointer and a chart are provided to assist the operator in selecting the proper character, but the character sheet and the chart are not interconnected or spacially fixed with respect to each other. Thus, when the character sheet must be changed to bring in other characters or symbols, both the character sheet and the chart might have to be changed. They will also have to be accurately realigned with respect to each other to insure accuracy in the machine.

Other problems or shortcomings existing in prior art machines involve undue complexities in operation or construction. In some machines, changing of the magnification ratio involves awkward manual readjustments and refocusing. In other machines, separate safe lamps and exposure lamps are provided, or else movable safe light filters are provided for moving to and from the optical path. In either case, the mechanical and optical design of the system is made more difficult or expensive.

SUMMARY OF THE INVENTION

To overcome these and other problems, the present invention provides a photocomposing machine in which the characters are provided on a fiche-like font of compact dimensions. The font has a first field of characters in positive form which may be viewed by the operator through a window of the machine. The font has a second field in negative image, which may also be reversed or inverted as required according to the optical system used for projecting the image on the film. The characters on the positive and negative fields are always spaced a constant distance from each other, and the font is carried by a frame which is freely movable in X and Y directions. To change characters, the operator simply moves the font carrying frame so as to bring the desired character directly over a small indexing lamp, which automatically brings the corresponding negative character in line with the optical system. The operator can see the entire positive field of characters, he does not have to go through a character-by-character search to find the right one, nor does he have to go through them in sequence. When the proper character is selected, an indexing mechanism locks the font carrying frame with the character accurately aligned in the optical path. Different type styles or different characters can be accommodated simply by replacing the font with another.

According to another aspect of the present invention, changes in magnification are accomplished by moving the font and light source of the optical system to shorten or lengthen the optical path. Simultaneously, the lens assembly which focuses the character on the image plane at the film is also moved along the optical path by a camming mechanism to automatically maintain proper focus.

According to yet another aspect of the present invention, a single lamp is used in the optical system, both as a safe lamp for use in adjusting and composing, and as a printing lamp. The lamp is driven with a relatively low current when used as a safe lamp, resulting in the emission of dim, yellowish-reddish light which does not affect the film, but which allows the operator, viewing through a safe filter, to adjust the position of the characters on the film. For printing, the lamp is supplied with a higher current to emit a stronger whitish light for exposing the film.

According to yet another aspect of the present invention, control circuitry is provided for sensing the degree of magnification, and adjusting the intensity of the lamp in the safe lamp mode, and the duration of the exposure in the printing mode.

BRIEF DESCRIPTION OF THE DRAWING

FIG. 5 is an elevational view as seen generally from the line 5—5 of FIG. 3;

FIG. 6 is a slightly reduced view in horizontal section as seen generally from the line 6—6 of FIG. 5;

FIG. 11 is a vertical sectional view taken generally along line 11—11 of FIG. 6.

DESCRIPTION OF THE PREFERRED EMBODIMENT

Figure 1:
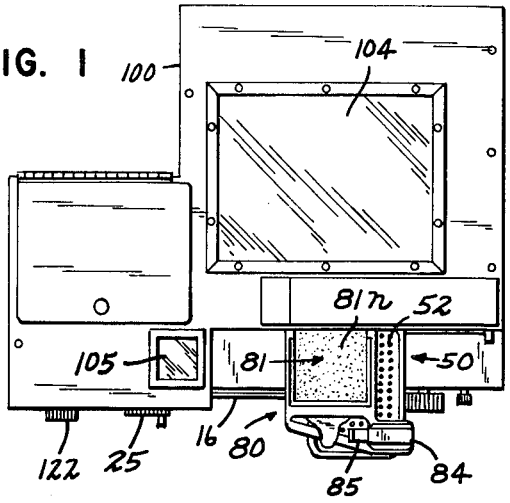
FIG. 1 is a view in top plan of a photocomposing machine according to the present invention.
Figure 2:
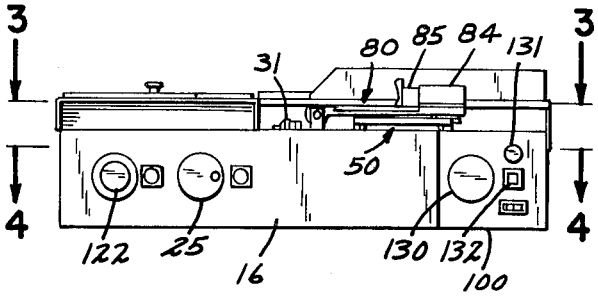
FIG. 2 is a view in front elevation of the machine of FIG. 1.
Figure 8:
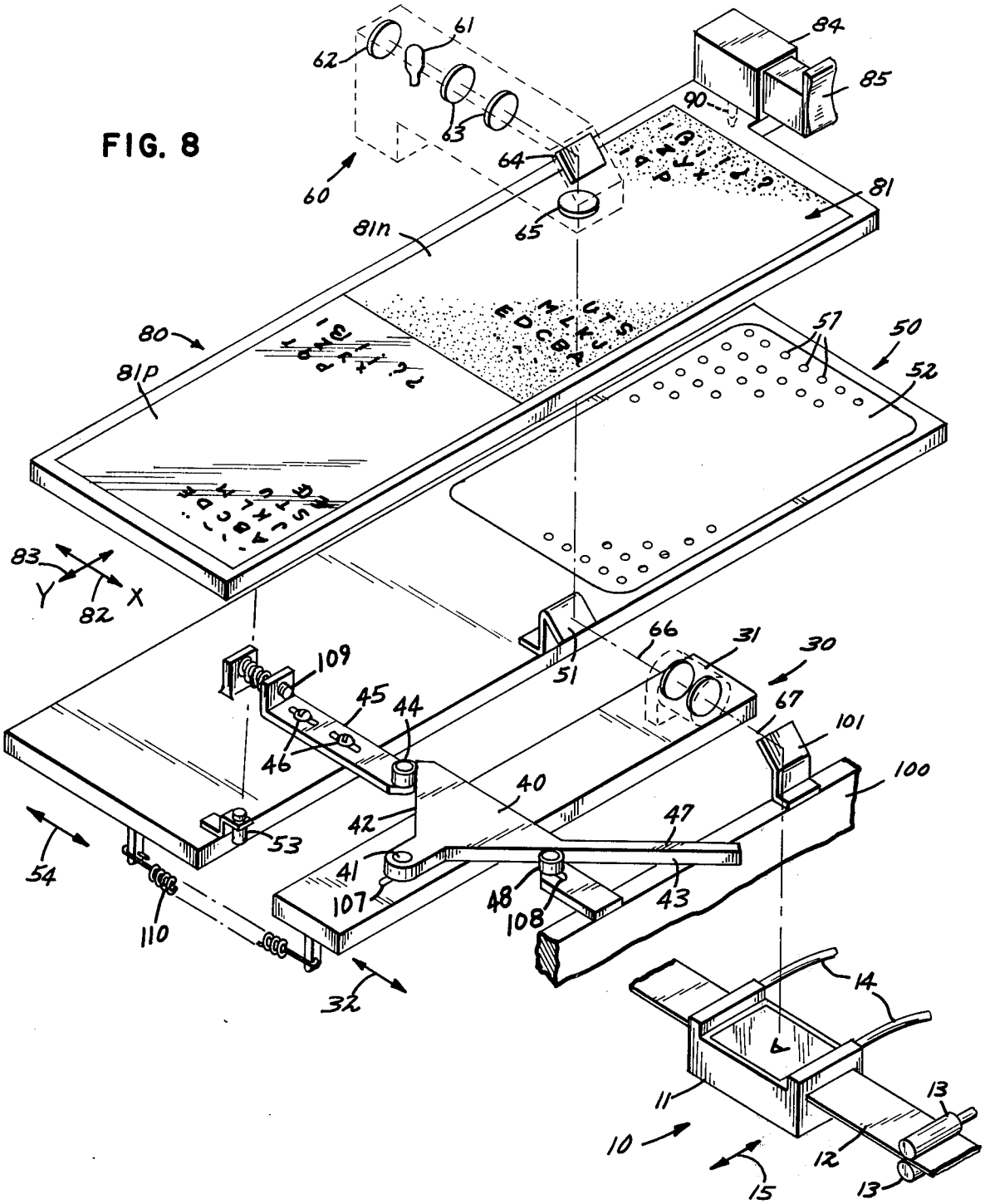
FIG. 8 is a diagrammatic view in perspective showing the major frames and subassemblies of the preferred embodiment of the photocomposing machine according to the present invention.

While the overall top and front views of the preferred embodiment of the present invention are shown in FIGS. 1 and 2, the schematic view of FIG. 8 best shows the functional relationships of the major components. In FIG. 8, most of the main frame of the machine has been omitted, and the major component frames or subassemblies have been shown in exploded diagrammatic view. In FIG. 8, reference number 10 generally designates the film deck, which is a subassembly mounted on the main frame (not shown) for handling the film and development functions. In FIG. 8, the developing cell 11 is shown with a strip of film or other light sensitive material passing therethrough. Advance rollers 13 are used for advancing film through the developing cell. Reference number 14 designates chemical supply tubes which supply the necessary chemicals to the developing cell from storage tanks (not shown) to develop the film, as is generally known in the prior art.

Reference number 30 generally designates another frame or subassembly of the overall machine referred to herein as the lens frame. Lens frame 30 includes the lens assembly 31 which is used to project font characters onto the film. It will be appreciated that lens assembly 31 may include a number of separate lens elements according to the lens design used, a couple of which are indicated in the drawing, as is generally known in the optical design field. Lens frame 30 is mounted on the main frame by means disclosed hereinafter which permit motion along an axis in the directions indicated by arrow 32.

Reference number 50 generally designates another major subassembly or frame of the overall device, referred to herein as the object frame. Object frame 50 is so named because it carries the type character objects which are to be imaged upon the film. Object frame 50 includes a mirror 51 having a surface at a 45° angle to the plane of the frame, an index plate 52 and a font index light 53, whose functions are explained hereinafter. Object frame 50 is mounted to the main frame by means explained hereinafter which permit motion in the directions indicated by direction arrow 54, which is the same as the directions indicated by direction arrow 32 for the lens frame 30.

Reference number 60 generally designates the lamp house, which is mounted to, and moves as a part of object frame 50. Lamp house 60 includes a lamp 61, a curved reflector 62 mounted behind the lamp, a pair of condenser lens 63, a mirror 64 mounted at a 45° angle with respect to the optical axis of the lamp and condensers, and a further condenser 65.

Reference number 80 generally designates the font frame. This frame holds the actual font 81 as explained more fully hereinafter. Font frame 80 is mounted to object frame 50, above the main part of object frame 50, but below lamp housing 60. Font frame 80 is positioned on means described more fully hereinafter which permit independent movement in two directions with respect to object frame 50. Specifically, font frame 80 can be moved in a first or X direction indicated by reference number 82, and in a second or Y direction as indicated by reference number 83.

An index head 84 mounted to font frame 80 cooperates with index plate 52 of the object frame for positioning the font frame as desired according to the character to be printed.

Only a portion of main frame 100 of the overall machine is shown in FIG. 8. To this portion is attached a mirror 101 which is mounted by means of a suitable bracket at a 45° angle with respect to the optical axis of lens assembly 31.

The font 81 includes a first planar field of characters 81*p* and a second planar field of characters 81*n*. The characters in field 81*p* are positive, and the characters in field 81*n* are negative, and reversed. The optical path of the system, indicated by reference numbers 66 and 67 passes through the field 81*n* so that a selected one of the characters can be projected on the film 12 within the developing cell 11. Optical path 66 extends from lamp 61, through condensers 63 to mirror 64, where it is bent at a vertical angle and passes through condenser 65. The optical path then passes through the plane of font 81, and specifically through whichever of the characters of field 81*n* is aligned therewith, according to the X and Y position of font frame 80 with respect to the object frame 50. Optical path 66 then extends to mirror 51 which is mounted to object frame 50 by a suitable mounting bracket. Mirror 51 is at a 45° angle so that optical path 66 passes horizontally through lens assembly 31. From the lens assembly, optical path 67 extends to mirror 101, where it is again deflected downward to the portion of film 12 which is within developing cell 11.

The optical system is designed to bring the character from field 81*n* into focus on the film, with a degree of magnification that is controllable. Specifically, means are provided for changing the path length from font 81 to lens assembly 31, and from lens assembly 31 to the image plane on film 12. This is accomplished by movement of object frame 50 and lens frame 30. In order to maintain focus, the distances of the optical paths on either side of the lens must be jointly controlled, and cam 40 and associated components perform this function. The detailed operation of focusing cam 40 is explained more fully hereinafter with reference to FIGS. 3 and 6.

To select a new character, index head 84 is released by pushing in pin release 85, enabling font frame 80 to be moved in the X and or Y directions to being a new character into the optical path. Fields 81*p* and 81*n* of font 81 are spaced so that the character in optical alignment with font index light 53 is mounted on object frame 50 is also aligned in optical path 66. Thus, the operator can move font frame 80 until the desired character is aligned with font light 53 with assurance that the same character will be brought into alignment for printing.

Means are provided for adjustment of film deck 10 throughout a small distance in the directions indicated by arrow 15, in order to permit placement of a character on, above or below the line of printing that is being generated.

Figure 3:
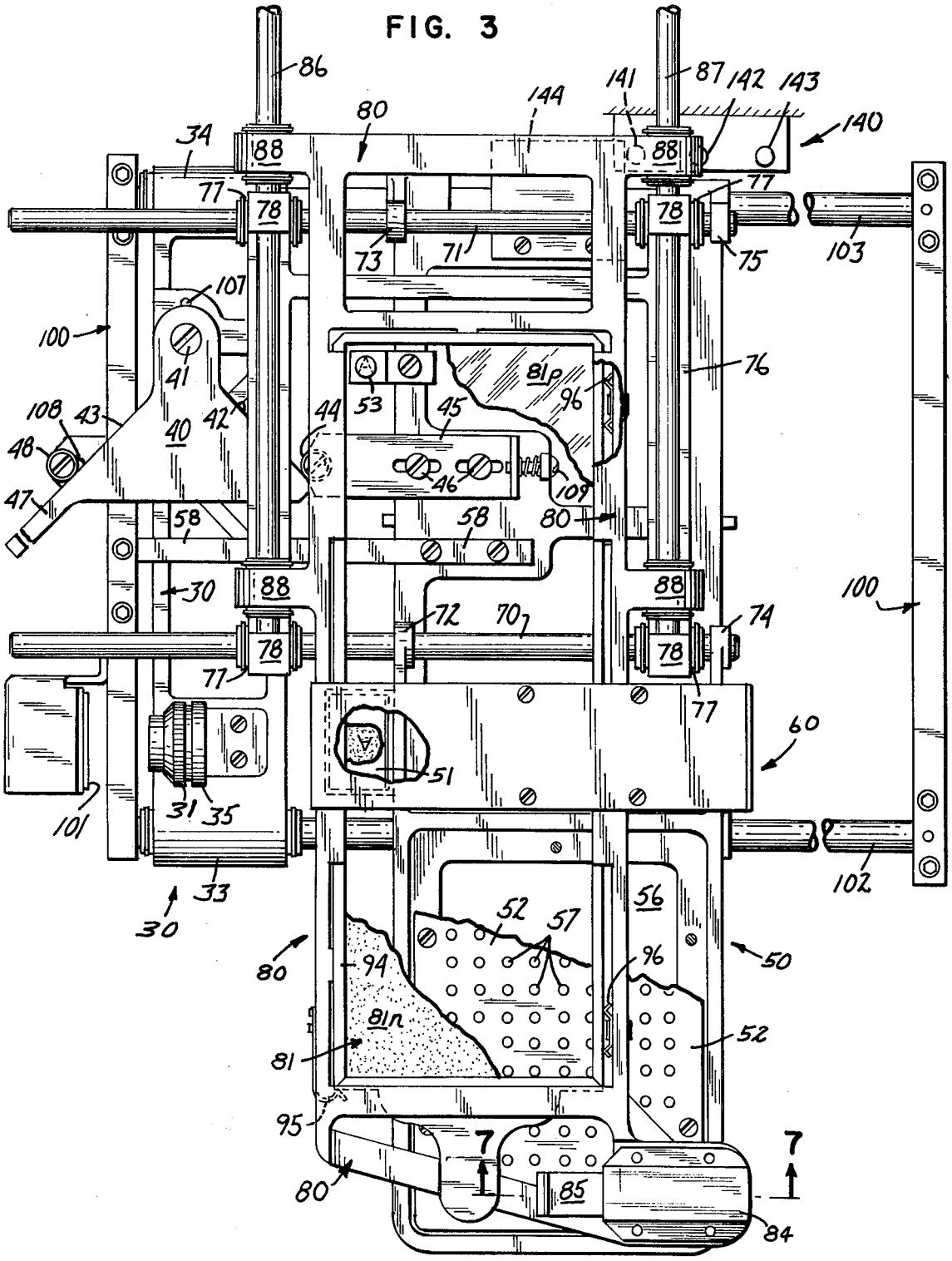
FIG. 3 is an enlarged view in horizontal section as seen generally from the line 3—3 of FIG. 2, portions of the housing not being shown.

Turning now to FIG. 3, a portion of the main housing 100 is shown at the right-hand side of the figure. Another portion of main housing 100 is shown towards the left of the figure, parallel to the first portion. A pair of main rails 102 and 103 extend between the portions of the main housing 100, and are fixedly attached thereto. These main rails, and other subsequently to be described may comprise elongate cylindrical members or rods along which other movable subassemblies slide.

Lens frame 30 is also shown in FIG. 3. Lens frame 30 is generally rectangular in overall shape, with end portions 33 and 34 forming sleeves mounted on rails 102 and 103 for sliding movement left and right in the figure. End portions 33 includes a bore into which is placed a sliding bearing sized to receive main rail 102. End portion 34 likewise has a sliding bearing which receives rail 103. Lens assembly 31 is mounted to lens frame 30 by means of an L bracket 35 which is threaded to receive the lens assembly. Cam 40 is pivotally connected to lens frame 30 by a pivot 41.

Object frame 50 which is also generally rectangluar in overall shape is seen in FIG. 3, and in FIG. 5. As seen in FIG. 5, object frame 50 is slidably mounted on the same main rails 102 and 103 to which lens frame 30 is slidably mounted. Specifically, object frame 50 includes leg portions which extend vertically downward to sleeves which are slidably positioned on the main rails. In FIG. 3, sleeves 54 and 55 are shown positioned on main rail 102, as is end portion 33 of lens frame 30. Similar sleeves at the other end of object frame 50 are slidably positioned on main rail 103, but are not visible in FIG. 3 or 5 because of other structures.

The portion of object frame 50 extending beyond main rail 102 includes a cut-out portion 56. Index plate 52 is mounted over this cut-out portion, by means of screws or any other suitable means. Index plate 52 contains a planar grid or array of index holes 57.

A pair of guides or rails 70 and 71 are positioned parallel to main rails 102 and 103, but are fixedly mounted to object frame 50. Specifically, rail 70 is fixedly mounted to frame 50 at 72 and 74. Similarly, rail 71 is fixedly mounted to object frame 50 at points 73 and 75. Rails 70 and 71 are referred to herein as the font X rails, since they are used to premit movement of font frame 80 in the X direction.

An H shaped intermediate frame 76 is positioned for movement in the X- direction on font X rails 70 and 71. At each of the extremities of H shaped frame 76, a bore and slidable bearing 77 is provided for receiving rails 70 and 71. Also at each of the four extemities of the H shaped intermediate frame 76 are provided vertically extending upright 78. These uprights support and fixedly position a pair of parallel rails 86 and 87 which are at right angles to rails 70 and 71, and which define the Y axis of movement of the font frame.

Font frame 80 is slidably positioned on rails 86 and 87 by means of the four ears 88 which contain suitable slide bearings for receiving rails 86 and 87.

It will thus be appreciated that both lens frame 30 and object frame 50 can move in the X direction with respect to the main housing, along rails 102 and 103. Font frame 80 can move in the X direction, along with intermediate frame 76, along font X rails 70 and 71. Font frame 80 can move in the Y direction along font Y rails 86 and 87.

The X and Y position of font frame 80 with respect to object frame 50 is selected with the aid of index head 84 and index plate 52. As seen in FIG. 3, index head 84 is positioned on an extension of font frame 80, above index plate 52.

Figure 7:
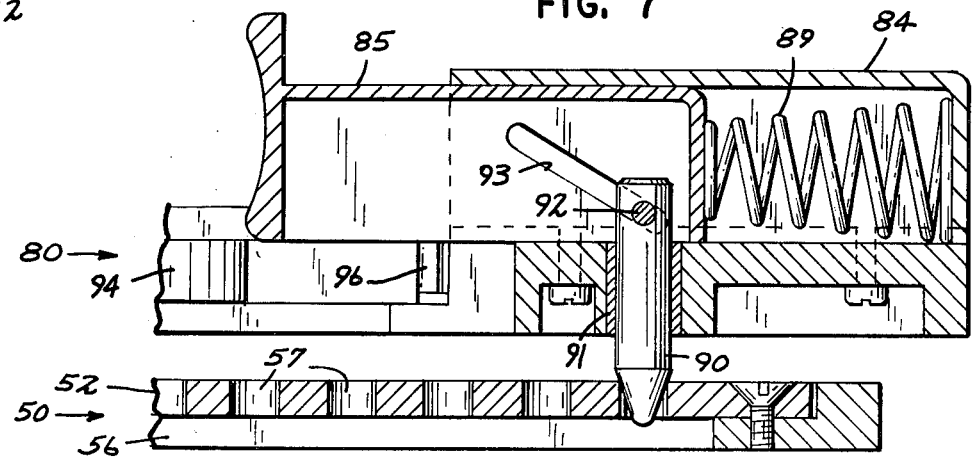
FIG. 7 is an enlarged view in section as seen generally along the line 7—7 of FIG. 3.

As seen in FIG. 7, index head 84 may be secured to font frame 80 by screws or any other suitable means. Pin release 85 is telescopically received in the open end of index head 84, but is normally urged outwardly by spring 89. A pin 90 extends downwardly through an opening in frame 80 into which a bearing sleeve 91 has been placed. Pin 90 has a tapered end which fits partway into index holes 57 in index 52. The upper end of pin 90 contains a transverse rod 92 which extends through pin 90 at right angles thereto and engages ramp slots 93 provided in pin release 85. As pin release 85 is pushed inwardly into index head 84, which can be done by grasping the index housing and pin release between thumb and fingers, transverse rod 92 is forced up the ramps slots 93, thus retracting pin 90. Referring again to FIG. 3, the font frame can then be moved directly to any other desired positions by a combination of simultaneous X and Y movements. Pin release 85 is then released, and pin 90 drops downwardly into the appropriate index hole 57, with the tapered end aiding in centering the mechanism.

Figure 4:
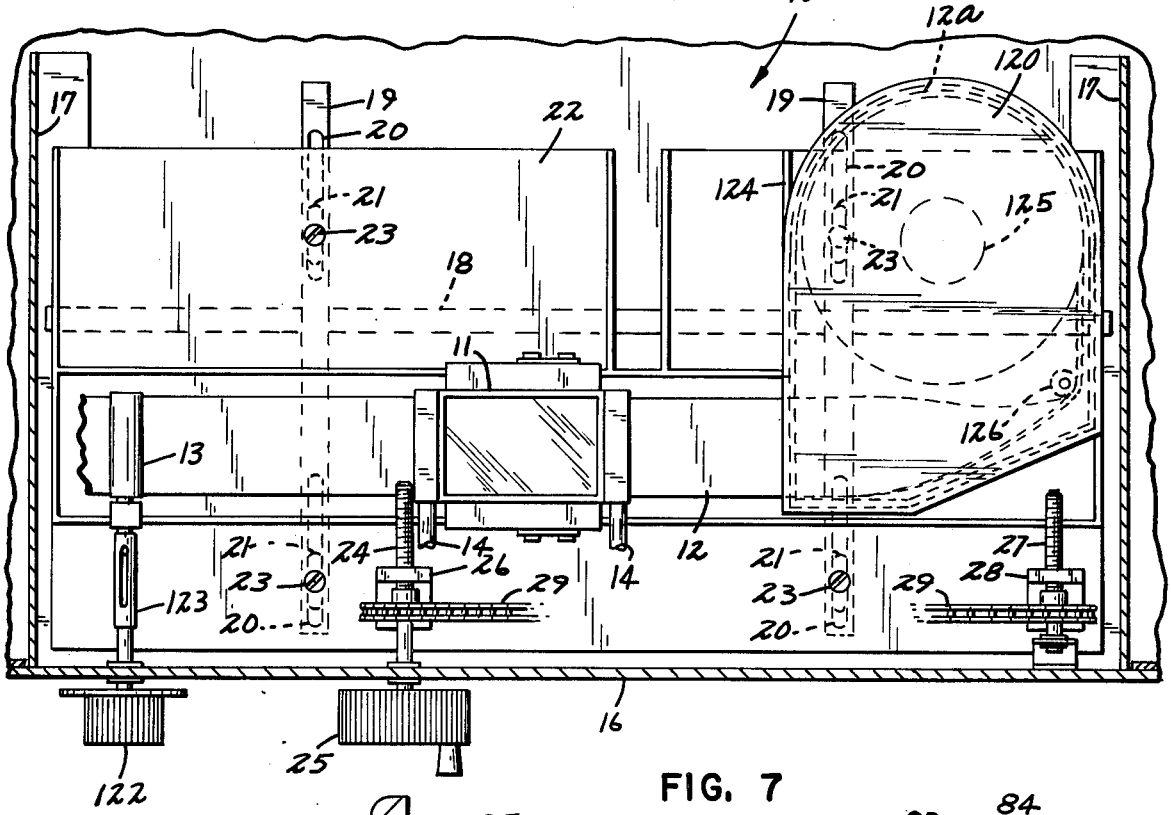
FIG. 4 is an enlarged view in horizontal section as seen generally from the line 4—4 of FIG. 2.

Referring now to FIG. 4, the film deck 10 shown in greater detail. For convenience, the entire film mechanism can be mounted in a drawer so that it may be pulled out from the main housing for servicing. Reference number 16 and 17 refer respectively to the front and sides of the film drawer. A drawer frame member 18 extends between drawer sides 17 and is attached thereto. A pair of transverse drawer frame members 19 attached to member 18. Members 19 have guide slots 20 formed therein.

Guide inserts 21 are slidably positioned within guide slots 20, and a mounting plate 22 of film deck 10 is secured by bolts 23 to each of the guide inserts 21. Thus, mounting plate 22 is capable of limited movement along slots 20.

A threaded shaft 24 having a knob 25 attached to one end extends through drawer front 16 by means of suitably bushings. Shaft 24 threadably engages the upright portion of L bracket 26, the lower portion of which is attached to mounting plate 21. A similar threaded shaft 27 threadably engages a hole in the upright portion of L bracket 28 which is also attached to mounting plate 21. A chain 29 and suitable sprockets interconnect threaded shafts 24 and 27 for simultaneous rotation. Thus, by rotation of knob 25, the threaded shafts are used to control fore and aft movements of film deck 10 along slots 20. This provides the desired motion for vertical alignment of the printed characters, as previously mentioned.

Also visible in FIG. 4 is film 12, and developing cell 11 which is secured to mounting plate 21 by means of a mounting bracket 121. Chemical containers are provided elsewhere in the main housing as is generally known in the prior art for connection to tubes 14. A solenoid or other mechanism is provided for delivering small quantities of chemicals as needed.

A film cassette 120 is provided for supplying the film. The cassette is positional horizontally on mounting pate 22 and is held in position by a ridge or wall 124, also seen in FIG. 5. The film 12 is a strip which is stored in cassette in a roll or pack 12*a* wound around a hub 125. As film is advanced, it comes off the roll, around a post 126, then transitions from vertical, on edge, to horizontal before exiting through a slot provided at the edge of the cassette.

A film advance knob 122 connects to an extensible shaft 123 to rollers 13 which control the film advance. The film can also be reversed by rollers 13 for short distances as required in accurate positioning of successive characters. Enough slack space is provided in the film path between the developing cell and the cassette to accommodate these small reverses of the film.

Figure 10:
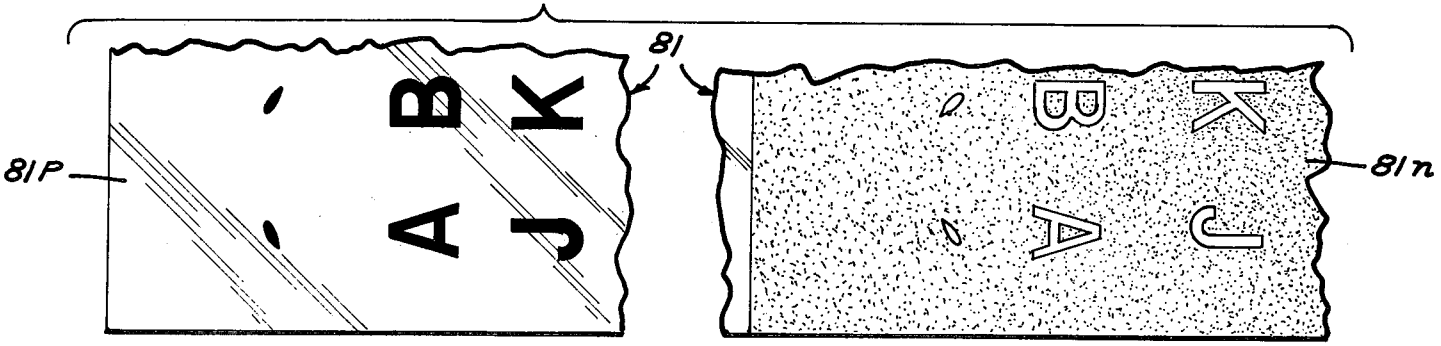
FIG. 10 is a fragmentary plan view of a font according to the present invention.

Details of the font are shown in FIG. 10, in which portions have been broken away. The font may be formed from a rectangular piece of film material which can be made by photographic process. The field of characters 81*p* includes relatively clear background with opaque letters. The negative field 81*n* has an opaque background with clear characters. The characters are inverted and reversed as required so that upon projection through the optical system they will form a properly oriented character at the image plane on the film. In making the font, the spacing of the characters in field 81*n* is accurately controlled to correspond to the spacing of the index holes in index plate 52. At the same time, the characters in field 81*p* are accurately positioned a constant distance from their corresponding character in the negative field, so that alignment of the positive character with the font index light 53 coincides with alignment of the negative character in optical path 66.

A given font may contain a full set of letters, both upper and lower case, as well as digits 0 through 9 and all punctuation marks. Additional fonts can be produced with as many different letter styles as desired. Switching from one type style to another is then simply accomplished by replacing the font in the machine.

The fonts can advantageously be made by a photographic process wherein original art works for the individual characters are successively photographed under controlled conditions using a camera with a precision X-Y positioning device, so that precise spacing of the characters is achieved.

With reference to FIG. 3, font 81 is supported by a font holder 94, which has channel-like sides and an open end into which the fonts can be slid. The font holder 94 in turn is held and supported by font frame 80, which has channel-like sides for receiving the holder. A pair of spring clips 96 positioned along one side of the font frame urge the font holder 94 to the left side of font frame 80 in FIG. 3, to ensure accurate and repeatable positioning. Font retainer clip 95 attaches to font frame 80, and holds font holder 94 and font 81 in place.

Lamp housing 60 is attached to object frame 50 by a suitable bracket, a portion of which is shown at reference number 68 of FIGS. 5 and 6. The lamp housing is supported at its back end, and it overlays the font frame 80. In FIG. 3, a portion of lamp housing 60 is broken away, as is a portion of mirror 64, to reveal the character A of the negative portion of the font in position in the optical path. At the same time, the corresponding character A of the positive character field of the font is positioned over font index light 53. As seen in FIG. 1, the main housing includes a large window 104 which is positioned generally over the area of the machine occupied by the positive font field 81*p*. Thus, during operation, it is a simple matter for the operator to look through window 104 to see in positive form, a complete array of all the characters and symbols available on the font. By grasping index head 84 and releasing pin release 85, font frame 80 can be directly repositioned from one character to another by use of X, Y or combined simultaneous X and Y movements.

Changing of size of the characters is accomplished by varying the magnification of the optical system. This can be done by the operator through the use of controls on the front panel. In FIG. 2, reference number 130 is the magnification adjustment control knob. By turning this knob, the magnification can be varied through a ratio of 4 to 1. A detent mechanism controlled by knob 131 can be selected to a detent position or to a variable position. In the detent position, rotation of knob 130 is detented at specific places corresponding to preselected type point sizes. In the variable position, the detents are released, and any size within the magnification range can be selected by knob 130. The selected magnification can be determined through a window 132 behind which is a display indicating the corresponding type point size which has been selected.

The magnification alterating mechanism and automatic focusing is best seen with reference to FIGS. 3, 6 and 8. Increasing the magnification of the image while still automatically maintaining focus can be accomplished by increasing the lengths of optical paths 66 and 67 according to the following formulas.

$$K_o + L_o = f[1 + (1/m)]$$

$$K_i + L_i = f(1 + m)$$

Where f is the focal length of lens assembly 31, m is the magnification, $K_o$ is the length of the portion of optical path 66 between the font and mirror 51, $L_o$ is the length of path 66 between mirror 51 and lense assembly 31, $K_i$ is the length of path 67 between mirror 101 and the film, and $L_i$ is the length of path 67 between lens assembly 31 and mirror 101. $K_o$ and $K_i$ are held constant, so magnification is controlled by control of $L_o$ and $L_i$.

Cam 40 is configured in accordance with these formulas to achieve the necessary length adjustments. Cam 40 has a roughly triangular body portion which is pivoted to lens frame 30 at pivot 41. Cam 40 has one cam surface 42 which is engaged by cam follower 44, which is a steel roller rotatably connected to a mounting bracket 45 which in turn is secured to object frame 50 by screws 46.

Cam 40 has a second surface 43 which is at right angles with respect to surface 42, and which extends outwardly along a protruding portion 47 of the cam body. Cam surface 43 is engaged by a cam follower 48 which is also a steel roller rotatably secured to a portion of main housing 100.

As seen in FIGS. 5 and 8, a tension spring 110 is connected between lens frame 30 and object frame 50, and tends to draw them towards each other, thus holding follower 44 in contact with surface 42 of cam 40. As seen in FIGS. 6 and 11, a rack 111 is secured to the underside of object frame 50. A pinion 112 engages rack 11, and connects through a shaft 113 to a reduction gear train 114. Gear train 114 ultimately connects to shaft 115 to which magnification controlled knob 130 is connected. Thus, rotational movement applied to know 130 causes movement of object frame 50. Also geared off gear train 114 is the detent mechanism 116 which connects to detent knob 131, and a disc 117 upon which indicia is printed according to the type point size of magnification. As control knob 130 is rotated, object frame 50 is moved and different portions of disc 117 become visible through window 132, giving the operator an indication of the degree of magnification. If detent mechanism 116 is activated by knob 131, the magnification mechanism will tend to stop at preselected points corresponding to standard type sizes. The use of reduction gears 114 permits precise and find adjustment of magnification.

As object frame 50 is moved to the right in FIGS. 3 or 6 to increase magnification, spring 110 tends to pull lens frame 30 along with it. However, the proper spacing between these two frames is maintained by surface 42 of the cam and follower 44. At the same time, the angular position of cam 40 is controlled by surface 43 and follower 48, and the distance between lens frame 30 and follower 48.

Likewise, as object frame 50 is moved to the left in FIG. 3 or 6, to decrease magnification, follower 44 pushes against cam 41 causing lens frame 30 to also move to the left. As the lens frame moves to the left, the cam is caused to pivot in a counterclockwise direction by follower 48, and this repositions the portion of surface 42 engaged by follower, 44, tending to increase the distance between lens frame 30 and object frame 50. In this manner, the distances $L_o$ and $L_i$ are controlled by cam 40 to automatically maintain focus as the magnification is changed.

It is desirable to provide suitable adjustments for the cam and cam followers so that slight variations in the focal length of the lens assembly or other variables can be accommodated during manufacture. For this purpose, slot 108 is provided for adjusting the position of follower 48. Similarly, mounting bracke 45 can be adjusted to adjust the position of follower 44. Slots are provided for screws 46, and an adjusting screw 109 can be provided to assist in positioning the mounting bracket. In similar manner, pivot 41 for cam 40 can be repositioned as required in slot 107 in lens frame 30.

In manufacture, these adjustments permit the usage of lens assembly 31 of moderate cost, which will have a variation in focal length from sample to sample of perhaps up to 10 percent. Once the position of the cam and followers has been adjusted for a given lens assembly, the adjustments are tightened down, and not further adjustment is required.

A stop member 58 is secured to object frame so by bolts or other suitable means, and it extends across and above lens frame 30 to engage a portion of main housing 100 when the object frame is fully to the left at the minimum magnification position as shown in FIG. 3. Stop 58 prevents damage to the mechanism by attempted continuation of rotation of the magnification control after the minimum point has been reached. FIG. 6 shows the position of the components with magnification control in a higher magnification position.

As previously mentioned, according to one aspect of the invention, the single lamp 61 is used both for viewing and composing, and for exposure. This is accomplished by supplying tungsten-halogen lamp 61 with a low average current for use during the viewing and composing stages. When supplied with a low current, lamp 61 burns dimly, and with a light output that is heavily shifted towards the yellow or red end of the spectrum. This yellowish dim light inherently acts as a safelight and does not affect the film 12. The operator can use this light to compose the position characters by controlling the position of the film by looking through safelight filter 105 to see the developing cell and the film in place therein. Window 105 is not placed directly above cell 11, because it would interfere with mirror 101 of the optical path. Instead, it is offset forwardly, but the operator can look therethrough at an angle and still see the film and developing cell.

For printing, full normal current is applied to lamp 61 which accordingly puts out a brighter, whiter light which is used for exposing the film to print the character.

This arrangement permits the use of a single bulb for both safe light and printing functions, thus simplifying the design of the optical system and eliminating any need for moveable safe filters. Also, a minimum current to the lamp is maintained at all times, keeping the filament and bulb warm and prolonging its life by avoidng continual abrupt turning on and off of the lamp.

It will be appreciated that as the magnification is increased, the light intensity falling on the film at the image plane will tend to decrease, both for the safe light mode and the exposure mode. In order to maintain a uniform intensity of the safe light and uniformity of exposure automatic controls are provided for lamp 61.

Sensors are provided to determine the position of object frame 50 with respect to the main housing 100, which of course is a measure of the magnification. A sensor array 140 is positioned on a portion of main housing 100 adjacent to object frame 50. Sensor array 140 includes individual optical sensors 141, 142 and 143. Each optical sensor includes a light source and a photodetector which are spaced apart from each other to allow a shutter to pass between them to cut the light path. The shuter is indicated by reference number 144, and it is attached to a portion of object frame 50 for movement therewith. The shuter is mounted and aligned to pass between the light sources and detectors of the optical sensors as the object frame moves.

The width of shutter 144, the spacing of optical sensors 141–143, and the positioning of sensor array 140 are selected to define six different zones or ranges of movement of object frame 50, corresponding to six different zones of magnification. These six zones are as follows: The first zone is shown in FIG. 3, in which none of the optical sensors are blocked. The second zone occurs after shutter 144 has moved to the right to block sensor 141. In the third zone, both sensors 141 and 142 are blocked, and in the fourth zone all three sensors are blocked. Subsequently, in the fifth zone which is shown in FIG. 6, the shutter has moved to the right far enough to reopen the path for optical sensor 141. In the sixth zone, both sensors 141 and 142 are open, and sensor 143 remains blocked. It will be readily apparent that different types of sensors could be used according to the present invention. For example, magnetic or mechanical sensing devices could be used instead of optical ones. Also, the range of magnification could be divided into more or less than 6 zones. Alternatively, an analog position transducer could be used for continuous sensing of the position if desired. However, in the preferred embodiment, the sixth zone sensing technique is used because it provides adequate control, of exposure within a minimum of cost.

Figure 9:
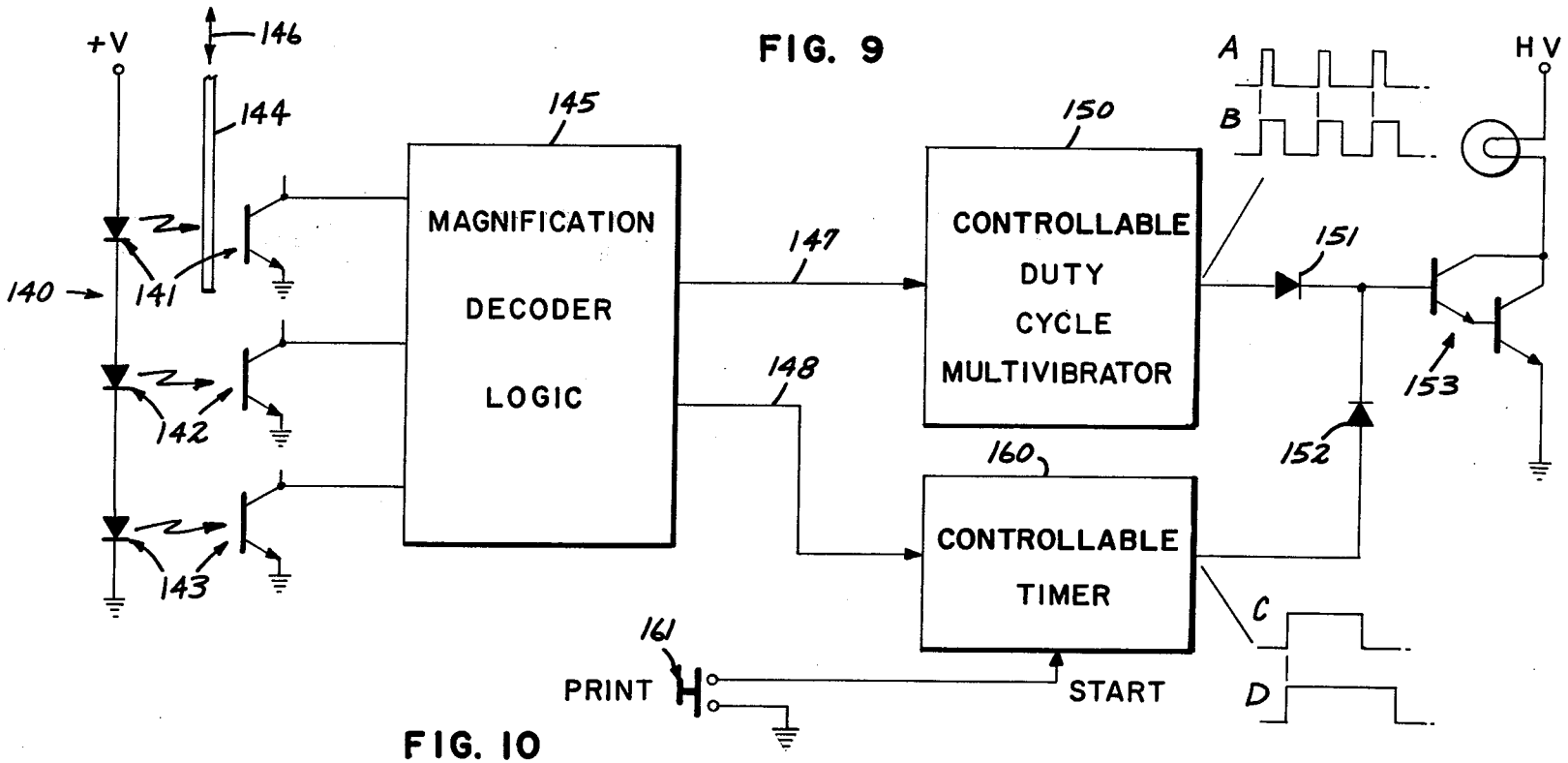
FIG. 9 is an electrical block diagram showing the exposure lamp control system according to the present invention.

The electrical control ccircuitry as shown in FIG. 9. Sensor array 140 includes individual light emitting diode-phototransistor pairs 141, 142 and 143. The light emitting diodes may be connected to a suitable source of working voltage indicated by the symbol V. The outputs of the phototransistors connect to a magnification decoder logic circuit indicated by reference number 145. In FIG. 9, shutter 144 is shown blocking the light path of sensor 141, and with the changes in magnification. The high or low outputs from the phototransistors are applied to the decoder logic, and the decoder logic provides outputs on control leads 147 and 148 according to the zone of magnification.

Reference number 150 designates a multivibrator circuit which has a variable duty cycle which can be controlled by suitable inputs on lead 147. In low magnification ranges, multivibrator 150 generates pulses having a relatively small on time or duty cycle as indicated by waveform B. Of course only two wave forms are shown, but it will be appreciated that six different duty cycles would be generated in the preferred embodiment. Alternatively, if more of fewer sensors were used, a corresponding number of different duty cycles would be provided, and if a continuously variable magnification signal were used, a continuously variable duty cycle multivibrator would be provided.

The output from multivibrator 150 is transmitted through diode 151 to the base of a power darlington switching transistor pair 153. The collectors of darlington pair 153 connect through lamp 61 to a power supply of suitable voltage according to the operating characteristics of the lamp. This voltage source is indicated by letters NV. The output emitter of darlington pair 153 connects to a ground for the voltage supply.

A controllable timer 160 is provided for exposure control. Magnification zone signals are supplied by lead 148 to timer 160, which functions to generate time interval signals according to which of the magnification zones the machine is in. Reference number 161 indicates a print switch which connects to timer 161 to initiate the time periods. Waveform C at the output of timer 160 shows a waveform for a lower magnification, which requires a relatively less exposure. When the print button is pushed, timer 160 starts its timing cycle which may last for several seconds or for whatever time interval has been determined as required for the exposure. At the end of this time interval, the timer switches off. Waveform D shows a longer time interval for a relatively higher degree of magnification.

Output signals from timer 160 pass through diode 152 to the base of darlington 153. Diodes 151 and 153 form an OR gate so that darlington 153 responds to the outputs of multivibrator 150 or timer 160.

During normal operation, timer 160 is off, and pulses from multivibrator 150 cause a switching action of darlington 153, sending pulses of current through lamp 61. The frequency of the pulses is designed to be high enough so that the thermal inertia of the bulb filament effectively integrates out the pulses so that no flicker is apparent. The light emitted by the lamp of course corresponds to the average current, and the duty cycle is selected to provide the desired low intensity, yellowish quality of light to serve as the safe light for composing. As different zones of magnification are selected, the duty cycle is adjusted according to the six zones previously described, so as to maintain the intensity of the safe light at the image plane relatively constant.

During a printing cycle, the longer duration pulses from timer 160 keep the lamp on for a corresponding period of time, and a much greater current is drawn through lamp 61, according to its electriccal characteristics and the voltage which is applied. The amount of current during the exposure is not varied or adjusted, but the time interval or duration of the exposure is scheduled according to the zones of magnification range. In the case of more or fewer magnification zones, or a continuous measurement of magnification, a corresponding number of time intervals, or a continuously variable time interval can be generated by timer 160 through suitable electrical design thereof, as is generally known in the electronic art.

From the foregoing description it will be seen that the present invention provides an improved photocomposing machine which uses a fiche-like font having a positive field of characters in full view of the operator, and a font carrying frame that may be quickly and directly repositioned in X and Y directions for selection of characters by moving the font until the desired characters is aligned with a font index light. At the same time, the corresponding negative of the character is positioned in the optical path for printing, and is positively located and held by an indexing mechanism.

Magnification can be varied by movements of frames carrying components of the optical system independently of the character selection mechanism, and focus is maintained automatically.

Use of the same lamp both for safe light and printing light simplifies design and prolongs the lamp life, while a control circuit automatically adjusts safe light intensity and exposure duration for changes in magnification.

The film cassette having a built in transition of the film from on-edge storage in a roll to a flat position at exit allows horizontal positioning of the cassette, and permits a smaller, move compact machine, adding further to the convenience and efficiency of operation.

I claim:

1. In a photocomposing machine of the type having a font of characters, a housing, an optical system for imaging individual ones of said characters on a film or other light sensitive material, and means for selecting which of said characters is to be imaged, the improvement which comprises a fiche-like font having first and second planar fields of characters with corresponding characters in the two fields spaced a predetermined distance apart, a font carrying frame connected within said housing for independent and simultaneous movements in two dimensions in the plane in which the font is held, said housing configured to display one of the font fields while the other is aligned in the optical system, and indexing means positioned in said housing in association with the displayed field spaced from said axis of the optical system according to said predetermined distance, whereby selection of characters with respect to said indexing means and in said first field simultaneously brings the selected character into said optical axis for printing.

2. A photocomposing machine according to claim 1 further including detent means associated with said font carrying frame and said housing for accurate two-dimensional positioning of individual characters in the optical axis.

3. A photocomposing machine according to claim 2 wherein said detent means includes a member attached to said housing having a planar grid of detent holes spaced according to the spacing of the characters on the font, and a detent pin connected with said font carrying frame and cooperating with said grid for positioning of the font carrying frame.

4. A photocomposing machine according to claim 1 wherein said font is removable from said font carrying frame, whereby the font may be replaced by fonts having different type styles.

5. A photocomposing machine comprising:

a housing;

a film holding deck;

an optical system including a lens assembly and a light source;

a lens frame mounted to said housing for movement in a first direction;

means for mounting said lens assembly to said lens frame;

a second frame mounted to said housing generally in the path of movement of said lens frame, for movement in the same direction as said lens frame;

means for mounting said light source to said second frame;

a font carrying frame mounted to said second frame for simultaneous and independent movements in first and second orthogonal directions with respect to said second frame and said optical path;

a fiche-like font and means for supporting said font upon said font carrying frame, said font having first and second planar fields of characters with corresponding characters of the two fields being based a predetermined distance apart;

said font carrying frame positioned so that one of said font fields is in said optical path;

said housing having an opening or window for display of the other of said font fields; and index means positioned on said second frame said predetermined distance from said optical path for alignment with the corresponding character of said other field.

6. A photocomposing machine according to claim 5 further including means for moving said second frame and said lens frame to control the magnification of the imaged characters.

7. A photocomposing machine according to claim 6 further including an autofocusing cam connected to said lens frame and engaging said housing and said second frame, whereby said lens frame is automatically positioned for proper focus as magnification is changed.

8. A photocomposing machine according to claim 5 wherein said film deck includes a film storage cassette mounted in a horizontal position to reduce the vertical dimensions of the housing.

9. A photocomposing machine according to claim 8 wherein said film cassette includes a roll or pack of film positioned on edge, and means for transitioning said film to a flat orientation for exit from the cassette.

10. A photocomposing machine according to claim 5 wherein said light source includes a single lamp, and further including control means for supplying said lamp with a relatively low current for operating said lamp as a safe light, and for supplying said lamp with intervals of higher current for operating said lamp as an exposure light.

* * * * *

UNITED STATES PATENT AND TRADEMARK OFFICE

CERTIFICATE OF CORRECTION

PATENT NO. : 4,141,632

DATED : February 27, 1979

INVENTOR(S) : Roger E. Mitchell

It is certified that error appears in the above-identified patent and that said Letters Patent are hereby corrected as shown below:

Column 4, line 62, "being" should be --bring--.

Column 5, line 57, "extemities" should be --extremities--.

Column 6, lines 47 & 48, "suitably" should be --suitable--.

Column 6, line 68, "pate" should be --plate--.

Column 8, line 66, "know" should be --knob--.

Column 9, line 10, "find" should be --fine--.

Column 9, line 36, "bracke" should be --bracket--.

Column 9, line 47, "not" should be --no--.

Column 9, line 49, "so" should be --50--.

Column 10, line 65, "ccircuitry" should be --circuitry--.

Column 10, line 65, "as" should be --is--.

Column 11, line 15, "wave forms" should be --waveforms--.

Column 11, line 67, "electriccal" should be --electrical--.

Column 12, line 16, "is" should be --are--.

Column 12, line 32, "move" should be --more--.

Column 12, line 52, the word "in" should be deleted.

Signed and Sealed this

*Third* Day of *July 1979*

[SEAL]

*Attest:*

*Attesting Officer*

LUTRELLE F. PARKER

*Acting Commissioner of Patents and Trademarks*